US007604328B2

(12) United States Patent
Yamada

(10) Patent No.: US 7,604,328 B2
(45) Date of Patent: Oct. 20, 2009

(54) LIQUID-JET HEAD, METHOD OF MANUFACTURING THE SAME AND LIQUID-JET APPARATUS

(75) Inventor: Masataka Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 480 days.

(21) Appl. No.: 11/475,126

(22) Filed: Jun. 27, 2006

(65) Prior Publication Data

US 2006/0290750 A1 Dec. 28, 2006

(30) Foreign Application Priority Data

Jun. 27, 2005 (JP) ..... 2005-185869

(51) Int. Cl.
*B41J 2/045* (2006.01)

(52) U.S. Cl. ..... 347/68

(58) Field of Classification Search ..... 347/68, 347/69–72, 5

See application file for complete search history.

(56) References Cited

U.S. PATENT DOCUMENTS

2005/0122351 A1* 6/2005 Yamazaki et al. ..... 347/5

FOREIGN PATENT DOCUMENTS

| | | | |
|---|---|---|---|
| JP | 2001-191532 | A | 7/2001 |
| JP | 2003-136-734 | A | 5/2003 |
| WO | WO 2005-028207 | A1 | 3/2005 |

* cited by examiner

*Primary Examiner*—K. Feggins
(74) *Attorney, Agent, or Firm*—Sughrue Mion, PLLC

(57) ABSTRACT

Included are a passage-forming substrate in which pressure generating chambers communicating respectively with nozzle orifices from which to eject ink droplets are formed; piezoelectric elements which are provided to one surface of the passage-forming substrate, and each of which is configured of a lower electrode, a piezoelectric layer and an upper electrode; and an insulation film which are provided at least areas corresponding to the piezoelectric elements in order that the insulation film can cover the piezoelectric elements, and which is made of an aluminum oxide thin film containing nitrogen.

6 Claims, 8 Drawing Sheets

LIQUID-JET HEAD, METHOD OF MANUFACTURING THE SAME AND LIQUID-JET APPARATUS

The entire disclosure of Japanese Patent Application No. 2005-185869 filed Jun. 27, 2005 is expressly incorporated by reference herein.

BACKGROUND

1. Technical Field

The present invention relates to a liquid-jet head, a method of manufacturing the liquid-jet head, and a liquid-jet apparatus. Specifically, the present invention relates to an inkjet recording head with the following configuration, a method of manufacturing the inkjet recording head, and an inkjet recording apparatus. In accordance with the configuration, parts respectively of pressure generating chambers communicating with corresponding nozzle orifices from which to eject ink droplets are constructed of a vibration plate, and piezoelectric elements are on the surface of this vibration plate. Accordingly, the ink droplets are ejected in response to displacement of the piezoelectric elements.

2. Related Art

An inkjet recording head with the following configuration can be enumerated as the liquid-jet head which ejects liquid droplets. In accordance with this configuration, for example, parts respectively of pressure generating chambers communicating with corresponding nozzle orifices are constructed of a vibration plate. This vibration plate is distorted by piezoelectric elements, and thus ink in each of the pressure generating chambers is pressurized. Thereby, ink droplets are ejected from the nozzle orifices. In addition, the following two types of inkjet recording heads have been put into practical use. A first type of inkjet recording head uses piezoelectric actuators of vertical vibration mode which extend and contract in the axial direction of the piezoelectric elements. A second type of inkjet recording head uses piezoelectric actuators of deflection vibration mode.

In addition, an inkjet recording head with the following configuration has been known as the inkjet recording head using the piezoelectric actuators of deflection vibration mode. In accordance with this configuration, for example, an even layer made of a piezoelectric material is formed on the entire surface of the vibration plate by use of a film-forming technique. Then, this layer made of the piezoelectric material is cut into shapes corresponding to the pressure generating chambers by the lithography method. Thereby, the piezoelectric elements are formed respectively for the pressure generating chambers in order that the piezoelectric elements can be independent from one another. Piezoelectric elements of this type can be arranged in a relatively high density.

Piezoelectric elements formed by use of the film-forming technique in this manner have an advantage that the piezoelectric elements can be arranged in a high density, and that print quality can be accordingly improved. However, the piezoelectric elements have a disadvantage, for example, that the piezoelectric elements are prone to be broken due to the external environment including dampness and the like.

There is an inkjet recording head with the following configuration for the purpose of making up for this unsatisfactory condition. In accordance with this configuration, for example, a sealing plate (a reservoir-forming plate) having a piezoelectric element holding portion is joined to a passage-forming substrate, and thus the piezoelectric elements are sealed up within this piezoelectric element holding portion (see JP-A-2003-136734, for example). Pressure generating chambers are formed in the passage-forming substrate. Even if, however, the piezoelectric elements are sealed up with the piezoelectric element holding portion, there is still a problem that the piezoelectric elements are broken due to dampness inside the piezoelectric element holding portion. This is because the dampness level inside the piezoelectric element holding portion gradually rises due to moisture coming into the piezoelectric element holding portion through an adhesion portion where the sealing plate and the passage-forming substrate are joined to each other.

In addition, there is an inkjet recording head in which, for example, the piezoelectric elements are covered with an insulation film made of an inorganic insulation material such as aluminum oxide (see International Publication WO-2005-0828207, for example). Indeed, such a configuration makes it possible to prevent the piezoelectric elements from being broken due to the external environment including dampness and the like. However, such a configuration has a problem, for example, that the configuration has a low resistance to chemical liquids including a developing solution. To put it another way, when the insulation film is soaked in a chemical liquid such as a developing solution after the insulation film is formed, the thickness of the insulation film becomes thinner. For this reason, the thickness with which the insulation film is formed has to be thicker than a desired thickness. Accordingly, this brings about a problem that the material is consumed wastefully, and that the piezoelectric elements are manufactured inefficiently. Moreover, while the film thickness of the insulation film is decreasing, the film thickness becomes uneven. As a result, it is likely that distortion of each of the piezoelectric elements may become uneven as well.

It should be noted that these types of problems are present not only in inkjet recording heads which eject ink droplets, but also in liquid-jet heads which eject liquid droplets other than the ink droplets.

SUMMARY

An advantage of some aspects of the present invention is to provide a liquid-jet head, a method of manufacturing the liquid-jet head, and a liquid-jet apparatus, which makes it possible to prevent distortion of each piezoelectric element from being uneven, and to improve manufacturing efficiency.

A first aspect of the invention is a liquid-jet head characterized by including a passage-forming substrate, piezoelectric elements and an insulation film. In the passage-forming substrate, pressure generating chambers are formed, and the pressure generating chambers communicate respectively with nozzle orifices from which to eject liquid droplets. The piezoelectric elements are provided on one surface of the passage-forming substrate with a vibration plate interposed between the passage-forming substrate and the group of the piezoelectric elements. Each of the piezoelectric elements is configured of a lower electrode, a piezoelectric layer and an upper electrode. The insulation film is provided to at least areas respectively corresponding to the piezoelectric elements in order that the piezoelectric elements can be covered with the insulation film. The insulation film is made of an aluminum oxide thin film containing nitrogen.

In the case of the first aspect, resistance of the insulation film to chemical liquids is improved to a large extent. Accordingly, this makes it possible to keep material consumption in check, and to improve efficiency. Moreover, this makes it possible to prevent distortion of the piezoelectric elements from being uneven.

A second aspect of the invention is the liquid-jet head according to the first aspect, characterized in that an amount of nitrogen contained in the insulation film is 1 wt % to 3 wt %.

The second aspect makes it possible to reliably improve the resistance of the insulation film to the chemical liquids without substantial change in various properties of the insulation film, which include resistance to moisture and rigidity.

A third aspect of the invention is the liquid-jet head according to anyone of the first and the second aspects, characterized in that the nitrogen contained in the insulation film is present in a way that the nitrogen is segregated in a vicinity of a surface layer of the insulation film.

If the insulation film is formed in a way that the nitrogen is segregated in the vicinity of the surface layer of the insulation film in accordance with the third aspect, this makes it possible to reliably improve the resistance of the insulation film to the chemical liquids.

A fourth aspect of the invention is the liquid-jet head according to any one of the first to third aspects, characterized in that the insulation film is formed by means of the CVD method or the sputtering method.

The fourth aspect makes it possible to more reliably improve the resistance of the insulation film to the chemical liquids.

A fifth aspect of the invention is a liquid-jet apparatus characterized by including the liquid-jet head according to any one of the first to the fourth aspects.

The fifth aspect makes it possible to realize the liquid-jet apparatus with improved reliability and durability.

A sixth aspect of the invention is a method of manufacturing a liquid-jet head, characterized by including a piezoelectric element forming step and an insulation film forming step. In the piezoelectric element forming step, piezoelectric elements are formed on one surface of a passage-forming substrate with a vibration plate interposed between the passage-forming substrate and the group of the piezoelectric elements. In the passage-forming substrate, pressure generating chambers are formed, and the pressure generating chambers communicate respectively with nozzle orifices from which to eject liquid droplets. Each of the piezoelectric elements is configured of a lower electrode, a piezoelectric layer and an upper electrode. In the insulation film forming step, an insulation film is formed in at least areas respectively corresponding to the piezoelectric elements in order that the piezoelectric elements can be covered with the insulation film. In addition, the method of manufacturing a liquid-jet head is characterized in that, in the insulation film forming step, a reactant gas containing a predetermined amount of nitrogen is added to a material gas, and thus the insulation film made of an aluminum oxide thin film containing nitrogen is formed.

In the case of the sixth aspect, resistance of the insulation film to chemical liquids is improved. Accordingly, this makes it possible to keep wasteful consumption of the material in check, and to accordingly improve manufacturing efficiency.

A seventh aspect of the invention is the method of manufacturing a liquid-jet head according to the sixth aspect, characterized in that, while the insulation film is being formed, an reactant gas containing a nitrogen gas which causes an amount of nitrogen contained in the insulation film to be 1 wt % to 3 wt % is supplied.

The seventh aspect makes it possible to form the insulation film, which has an improved resistance to the chemical liquids, without substantially changing properties of the insulation film, which include resistance to moisture and rigidity.

An eighth aspect of the invention is the method of manufacturing a liquid-jet head according to any one of the sixth and the seventh aspects, characterized in that the insulation film is formed by means of the CVD method or the sputtering method.

The eighth aspect makes it possible to form the insulation film, which has the improved resistance to the chemical liquids, in a relatively easy and satisfactory manner.

DESCRIPTION OF EXEMPLARY EMBODIMENTS

Detailed descriptions will be provided below for the invention on the basis of the embodiments.

Embodiment 1

Figure 1:
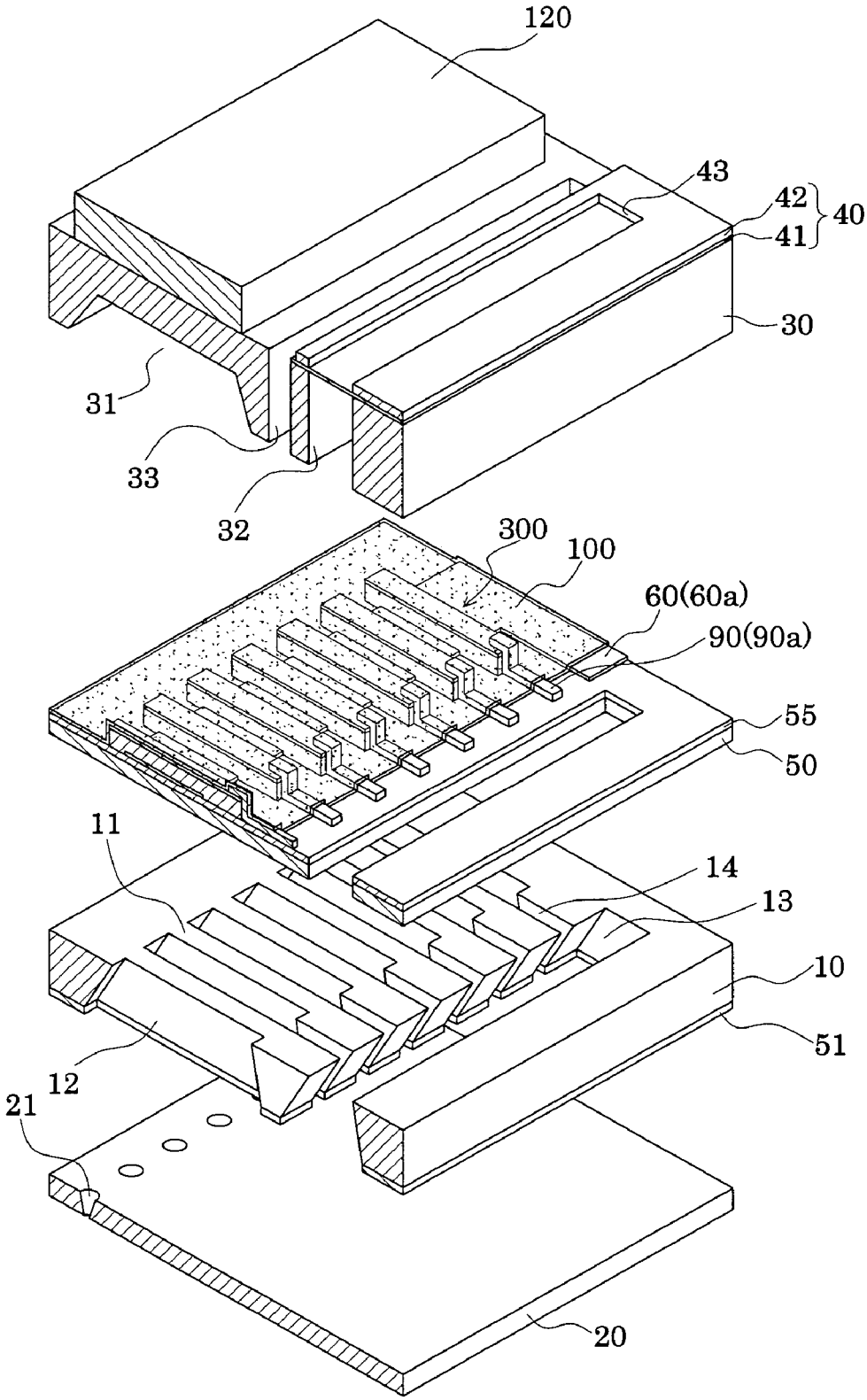
FIG. 1 is an exploded, perspective view of a recording head according to embodiment 1.
Figure 2A:
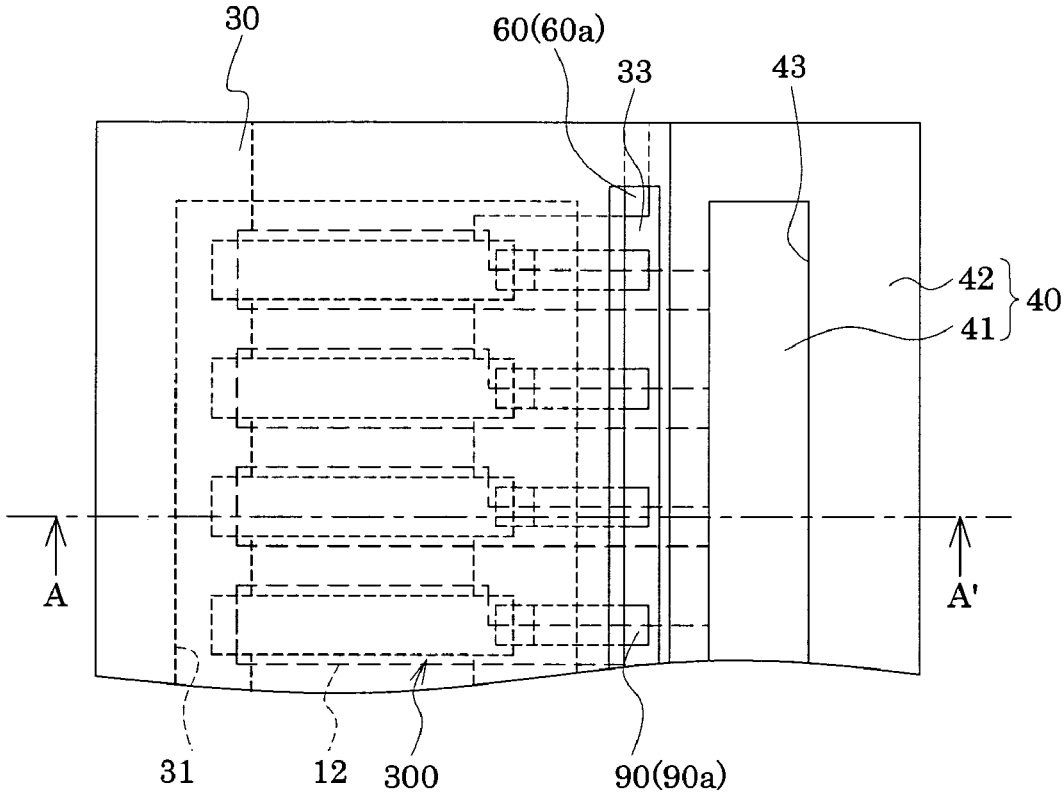
FIGS. 2A and 2B are respectively a plan view of, and a cross-sectional view of, the recording head according to embodiment 1.
Figure 2B:
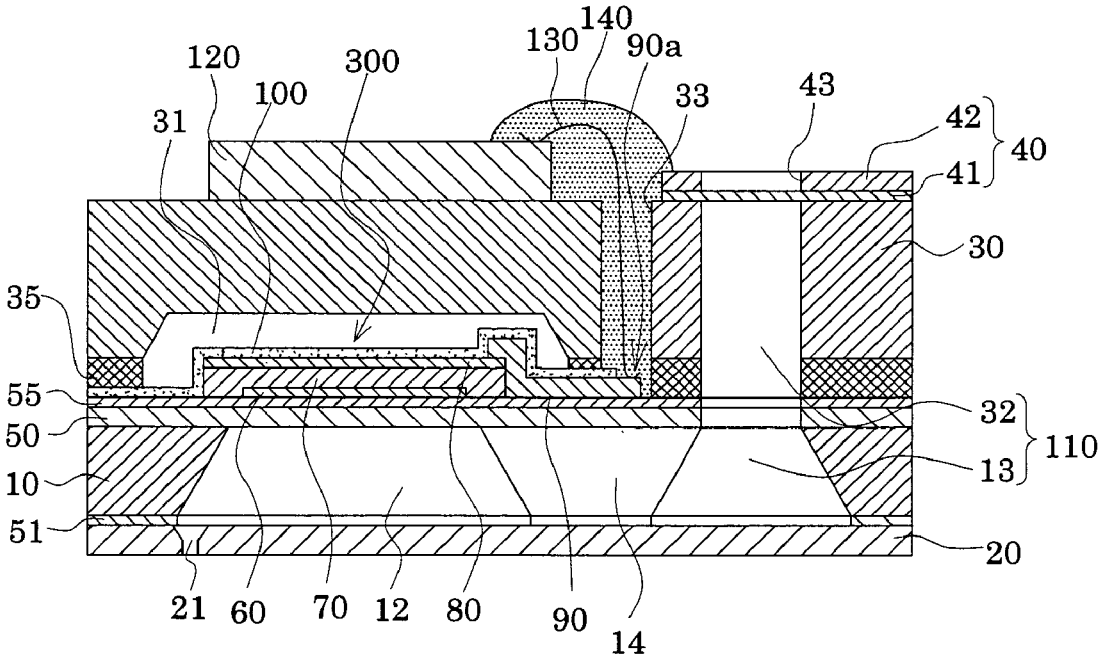

FIG. 1 is an exploded, perspective view showing an inkjet recording head according to embodiment 1 of the invention. FIGS. 2A and 2B are respectively a plan view of, and a cross-sectional view of, the inkjet recording head shown in FIG. 1. In the case of this embodiment, a passage-forming substrate 10 is made of a single crystal silicon substrate in which silicon crystals on the face surface are oriented in the (110) plane orientation. As illustrated, an elastic film 50 made of silicon dioxide is formed beforehand on one surface of the passage-forming substrate by thermal oxidation. The elastic film 50 has a thickness of 0.5 to 2 μm. In the passage-forming substrate 10, a plurality of pressure generating chambers 12 are provided side-by-side in the width direction of the passage-forming substrate 10. In addition, a communicating portion 13 is formed in an area outside the pressure generating chambers 12 in the longitudinal direction in the passage-forming substrate 10. The communicating portion 13 and the pressure generating chambers 12 communicate with each other respectively through ink supply paths 14 provided to the pressure generating chambers 12. Incidentally, the communicating portion 13 communicates with a reservoir portion in a protection plate which will be described later, and thus constitutes a part of a reservoir which serves as a common ink chamber for the pressure generating chambers 12. The ink supply paths 14 are formed respectively with widths narrower than those of the corresponding pressure generating chambers 12. Thus, the ink supply paths 14 keep passage resistance of ink constant, the ink flowing from the communicating portion 13 to the respective pressure generating chambers 12.

In addition, a nozzle plate 20 is fixed to a surface of the passage-forming substrate 10, which surface faces orifices, with a mask film 51 interposed between the nozzle plate 20 and the passage-forming substrate 10 by use of an adhesive agent, a thermal adhesive film or the like. In the nozzle plate 20, nozzle orifices 21 are pierced. The nozzle orifices 21 communicate respectively with vicinities of ends of the pressure generating chambers 12, the ends being opposite to ends of the pressure generating chambers 12 where the pressure generating chambers 12 communicate with the ink supply paths 14. The mask film 51 is used as a mask while the pressure generating chambers 12 are being formed. Incidentally, the nozzle plate 20 is made, for example, of glass ceramic, a single crystal silicon substrate, stainless steel or the like.

On the other hand, as described above, the elastic film 50 is formed on a surface of such a passage-forming substrate 10, the surface being opposite to the surface of the passage-forming substrate 10, which surface faces orifices. The elastic film 50 has a thickness, for example, of approximately 1.0 μm. On this elastic film 50, an insulation film 55 made of zirconia or the like is formed. The thickness of the insulation film 55 is, for example, approximately 0.4 μm. Moreover, a lower electrode film 60, a piezoelectric layer 70 and an upper electrode film 80 are formed on this insulation film 55 by laminating them over each other on the insulation film 55. Thus, each piezoelectric element 300 is configured of the lower electrode film 60, the piezoelectric layer 70 and the upper electrode film 80. The lower electrode film 60 is made of platinum, iridium or the like, and the thickness of the lower electrode film 60 is, for example, approximately 0.2 μm. The piezoelectric layer 70 is made of lead-zirconate-titanate or the like, and the thickness of the piezoelectric layer 70 is, for example, approximately 1.0 μm. The upper electrode film 80 is made of iridium or the like, and the thickness of the upper electrode film 80 is, for example, approximately 0.05 μm. In this respect, a part including the lower electrode film 60, the piezoelectric layer 70 and the upper electrode film 80 is termed as the "piezoelectric element" 300. In general, the piezoelectric element is configured in the following manner. One of the two electrodes of the piezoelectric element 300 is used as a common electrode. The other of the two electrodes of the piezoelectric element 300 and the piezoelectric layer 70 are patterned for each of the pressure generating chambers 12. Incidentally, in the case of this embodiment, the lower electrode film 60 is used as the common electrode of the piezoelectric elements 300, and the upper electrode film 80 is used as an individual electrode of each of the piezoelectric elements 300. However, it does not matter that the use of the lower electrode film 60 and the upper electrode film 80 is the other way around for the convenience of arrangement of a drive circuit and interconnects.

Furthermore, an insulation film is formed in at least areas respectively corresponding to these piezoelectric elements 300, and the piezoelectric elements 300 are covered with this insulation film. In the case of this embodiment, for example, lead electrodes 90 are connected respectively to the upper electrode films 80 which are the individual electrodes of the piezoelectric elements 300. Voltage is designed to be selectively applied to each of the piezoelectric elements 300 through its corresponding one of these lead electrodes 90. In addition, the insulation film 100 is provided to a pattern area including the lower electrode film, the piezoelectric layers and the upper electrode films of the piezoelectric elements 300 as well as the lead electrodes 90 in order that the insulation film 100 can substantially cover the pattern area.

Figure 3:
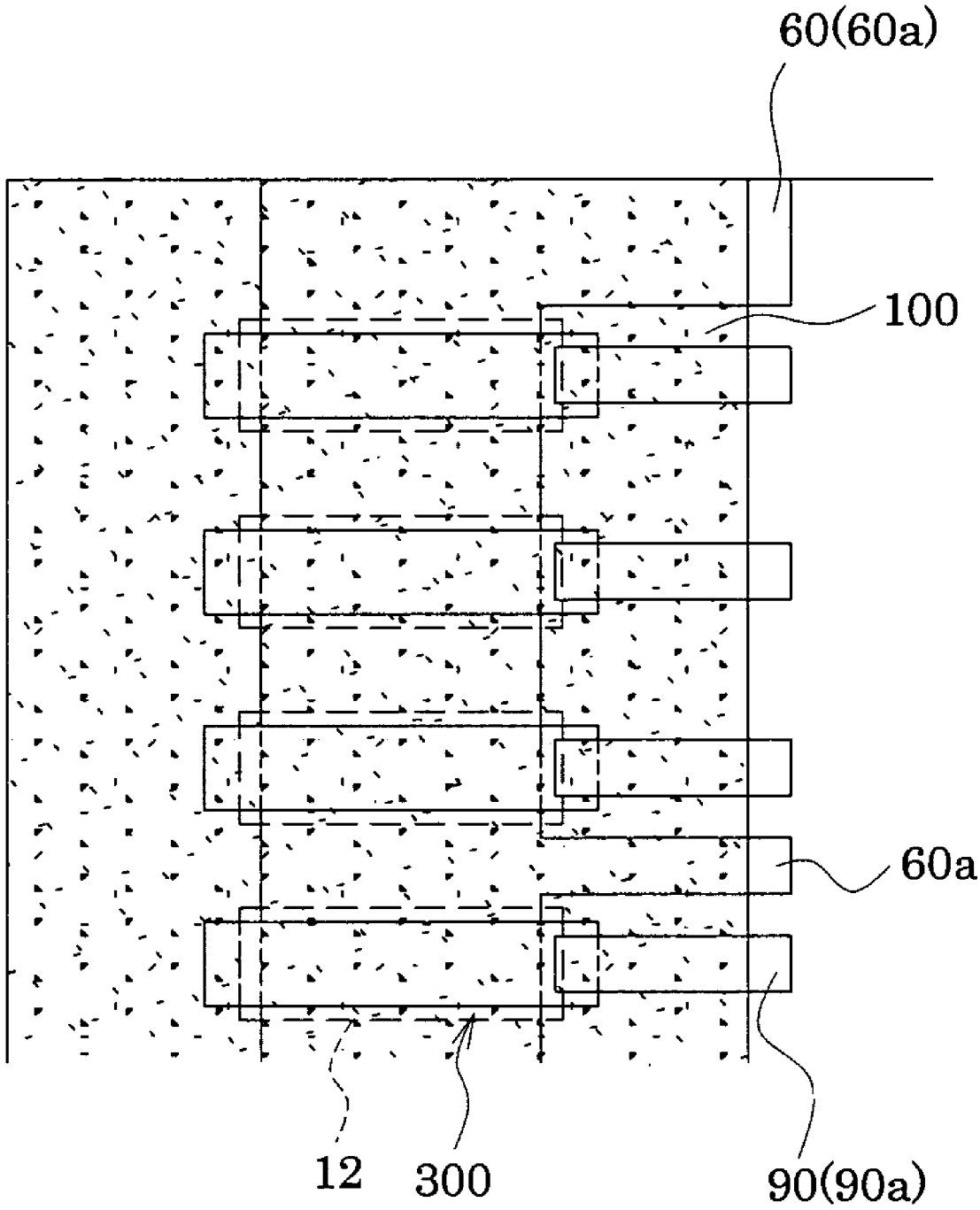
FIG. 3 is a plan view showing a main part of the recording head according to embodiment 1.

Specifically, in the case of this embodiment, as shown in FIG. 3, the lower electrode film 60 is formed in areas respectively facing the pressure generating chambers 12, as far as the longitudinal direction of the pressure generating chambers 12 is concerned. The lower electrode film 60 is continuously provided to areas respectively corresponding to the plurality of pressure generating chambers 12. In addition, the lower electrode film 60 is extended to a vicinity of the communicating portion 13 in the two outer sides of the row of the pressure generating chambers 12 and in interstices between each neighboring two of the pressure generating chambers 12. End portions of the extended parts of the lower electrode film 60 in the two outer sides of the row of the pressure generation chambers 12 serve respectively as connection portions **60*a* to which connecting wires 130 are connected. The connecting wires 130 are extended from a driver IC 120, which will be described later. The piezoelectric layers 70 and the upper electrode films 80 are basically provided to the areas respectively facing the pressure generating chambers 12. As far as the longitudinal direction of the pressure generating chambers 12, however, the piezoelectric layers 70 and the upper electrode films 80 are extended beyond the edge of the lower electrode film 60. Thus, end surfaces of the lower electrode 60 are covered with the piezoelectric layers 70. In addition, the lead electrodes 90 are extended from vicinities of end portions of the respective upper electrode films 80 to a vicinity of the communication portion 13 via end surfaces of the piezoelectric layers 70. Extremities of the lead electrodes 90 serve as connection portions 90*a* to which the other connecting wires 130 are respectively connected, as in the case of the lower electrode film 60. Furthermore, the pattern area including the lower electrode film, the piezoelectric layers and the upper electrode films constituting the piezoelectric elements 300 as well as the lead electrodes 90 is substantially covered with the insulation film 100. In other words, the pattern area including the lower electrode film, the piezoelectric layers and the upper electrode films constituting the piezoelectric elements 300 as well as the lead electrodes 90 is covered with the insulation film 100, except for areas facing the connection portions 60*a* of the lower electrode film 60 and the connection portions 90*a* of the lead electrodes 90**.

In this respect, this insulation film 100 is made of an aluminum oxide (for example, $Al_2O_3$) thin film containing a small amount of nitrogen. It is desirable that an amount of nitrogen contained in the insulation film 100 should be approximately 1 wt % to 3 wt %. In addition, it does not matter whether the nitrogen contained in the insulation film 100 is singly in the form of $N_2$ or in the form of aluminum oxynitride ($Al_xO_yN_z$) formed through combination of at least part of the nitrogen with the aluminum oxide.

Such an insulation film 100 exhibits extremely low moisture permeability, although the insulation film 100 is a thin film. Accordingly, coverage of the surfaces respectively of the piezoelectric elements 300 and the lead electrodes 90 with this insulation film 100 makes it possible to prevent the piezoelectric layers 70 from being damaged due to moisture (dampness). Furthermore, even if the insulation film 100 is formed considerably thin, for example, in a thickness of approximately 100 nm, the insulation film 100 can fully prevent moisture from permeating through the insulation film 100 in a high-moisture environment.

The insulation film 100 according to the invention exhibits, for example, remarkably improved resistance (chemical-liquid resistance) to various chemical liquids, including a developing solution, an etchant and a primer, due to the small amount of nitrogen contained in the insulation film 100. Accordingly, this makes it possible to control the film thickness of the insulation film 100 from decreasing, even if the insulation film 100 is soaked in such chemical liquids during the manufacturing process. As a result, even if the film thickness obtained while the insulation film 100 is being formed is thinner, the insulation film 100 with a desired thickness can be finally formed. In addition, this cuts down on consumption of the material. For this reason, the insulation film 100 can be formed extremely efficiently. As well, the controlling of the film thickness of the insulation film 100 from decreasing makes it possible to form the insulation film 100 more even in thickness, and to accordingly prevent amounts of displacements of the piezoelectric elements 300 from varying from one piezoelectric element to another.

Moreover, it does not matter whether the nitrogen contained in the insulation film 100 is almost homogeneously dispersed in the insulation film 100 or is present in a way that the nitrogen is segregated around the surface layer of the insulation layer 100. In this case, even if the amount of nitrogen contained in the insulation film 100 is relatively small, the chemical-liquid resistance is secured in at least the surface layer portion of the insulation film 100. As a result, this makes it possible to control the film thickness of the insulation film 100 as a whole from decreasing.

The insulation film 100 made of the aluminum oxide which contains such a small amount of nitrogen is formed, for example, by means of the CVD method, the sputtering method or the like. Thereafter, the insulation film 100 is patterned into a predetermined shape, and thus is completed. In the case of the invention, while the insulation film 100 is being formed, a reactant gas containing a predetermined amount of nitrogen gas is added. Thereby, the insulation film 100 made of aluminum oxide which contains the small amount of nitrogen is formed. It suffices that an amount of added nitrogen gas is adjusted whenever deemed necessary in order that the amount of nitrogen contained in the insulation film 100 can be approximately 1 wt % to 3 wt %. For example, in a case where the insulation film 100 is formed by means of the CVD method, it suffices that the nitrogen gas is added in an amount approximately equal to the amount of the added material gas.

The formation of the insulation film 100 by means of such a method makes it possible to relatively easily and satisfactorily form the insulation film 100 made of aluminum oxide, which contains the small amount of nitrogen, and which exhibits excellent chemical-liquid resistance.

It should be noted that, in the case of this embodiment, a protective plate 30 is joined to the passage-forming substrate 10, on which the piezoelectric elements 300 covered with such an insulation film 100 are formed, with an adhesive agent 35 interposed between the protective plate 30 and the passage-forming substrate 10. The protective plate 30 has a piezoelectric-element holding portion 31, which can insure a space large enough not to hinder the piezoelectric elements 300 from moving, in an area facing the piezoelectric elements 300. The piezoelectric elements 300 are in the piezoelectric-element holding portion 31. Thus, the piezoelectric elements 300 are protected in a way that the piezoelectric elements 300 are hardly susceptible to influence of the external environment. Moreover, in the protective plate 30, a reservoir portion 32 is provided to an area corresponding to the communicating portion 13 in the passage-forming substrate 10. In the case of this embodiment, this reservoir portion 32 penetrates through the protective plate 30 in the depth direction, and is provided thereto in the same direction as the pressure generating chambers 12 are arranged side-by-side. As described above, the reservoir portion 32 communicate with the communicating portion 13 in the passage-forming substrate 10, and thus constitutes the reservoir 110 which serves as the common ink chamber for the pressure generating chambers 12.

Furthermore, a penetrated hole 33 is provided to an area between the piezoelectric-element holding portion 31 and the reservoir portion 32 in the protective plate 30. The penetrated hole 33 penetrates through the protective plate 30 in the depth direction. Thus, the connection portions 60*a* of the lower electrode film 60 and the connection portions 90*a* of the lead electrodes 90 are exposed to the inside of the penetrated hole 33. Additionally, ends of the connecting wires 130 extended from the driver IC 120 mounted on the top of the protective plate 30 are connected respectively to the connection portions 60*a* of the lower electrode film 60 and the connection portions 90*a* of the lead electrodes 90. A sealing material 140 which is an organic insulation material is filled into the penetrated hole 33 to which these connecting wires are extended. In the case of this embodiment, the sealing material 140 is a potting material, for example. The connection portions 60*a* of the lower electrode film 60, the connection portions 90*a* of the lead electrodes 90 and the connecting wires 130 are completely covered with this sealing material 140.

It should be noted that, for example, glass, a ceramic material, a metal, a resin and the like can be enumerated as the material for the protective plate 30. However, it is desirable that the protective plate 30 should be formed of a material with a coefficient of thermal expansion which is approximately equal to that of the passage-forming substrate 10. In the case of this embodiment, the protective plate 30 is formed of a single crystal silicon substrate which is the same as the material of the passage-forming substrate 10.

In addition, a compliance plate 40 is joined to the top of the protective plate 30. The compliance plate 40 is configured of a sealing film 41 and a fixing plate 42. The sealing film 41 is made of a flexible material with a low rigidity (for example, a polyphenylene sulfide (PPS) film with a thickness of 6 μm). One side of the reservoir portion 32 is sealed up with this sealing film 41. Furthermore, the fixing plate 42 is made of a hard material such as a metal (for example, a stainless steel (SUS) with a thickness of 30 μm). An area of the fixing plate 42 which faces the reservoir 110 constitutes an opening portion 43 obtained by removing the area in the depth direction completely. For this reason, the side of the reservoir 110 is sealed up only with the sealing film 41 which is flexible.

Such an inkjet recording head according to this embodiment takes in ink from external ink supply means, which is not illustrated, and thus fills the interior ranging from the reservoir 110 to the nozzle orifices 21 with the ink. Thereafter, the inkjet recording head applies voltage between the lower electrode film 60 and each of the upper electrode films 80 respectively corresponding to the pressure generating chambers 12 in accordance with recording signals from the driver IC 120. Thus, the inkjet recording head distorts the piezoelectric elements 300 with flexure. Thereby, pressure in each of the pressure generating chambers 12 is increased, and ink is ejected for the nozzle orifices 21.

In this regard, insulation films according to an example and insulation films according to a comparative example were formed respectively on silicon substrates. The insulation films according to the example were made of aluminum oxide, and contained a small amount (1 wt % to 3 wt %) of nitrogen. The insulation films according to the comparative example were made of aluminum oxide, and contained no nitrogen. The insulation films according to the example were soaked respectively in a developing solution, an etchant and a primer. The insulation films according to the comparative example were soaked respectively in the developing solution, the etchant and the primer. The etchant was a mixed liquid of a phosphoric acid, an acetic acid and a nitric acid. The primer is a silane coupling agent. Measurements were taken for how much the film thicknesses respectively of the insulation films were reduced after the insulation films were soaked in the developing solution, the etchant or the primer. Table 1 shows a result of this measurement.

TABLE 1

| CHEMICAL LIQUID | | SOAKED TIME | PRE-SOAKED FILM THICKNESS (nm) | POST-SOAKED FILM THICKNESS (nm) | AMOUNT OF DECREASED FILM THICKNESS (nm) |
|---|---|---|---|---|---|
| DEVELOPING SOLUTION (ROOM TEMPERATURE) | EXAMPLE | 5 MINUTES | 57.39 | 53.93 | 3.46 |
| | COMPARATIVE EXAMPLE | 5 MINUTES | 38.88 | 28.01 | 10.87 |
| ETCHANT (50° C.) | EXAMPLE | 5 MINUTES | 57.85 | 49.51 | 8.34 |
| | COMPARATIVE EXAMPLE | 5 MINUTES | 38.83 | 15.80 | 23.03 |
| PRIMER (ROOM TEMPERATURE) | EXAMPLE | 60 MINUTES | 53.93 | 50.94 | 2.99 |
| | COMPARATIVE EXAMPLE | 60 MINUTES | 37.80 | 33.17 | 4.63 |

It is learned that, as shown in Table 1, amounts of decreased film thicknesses of the insulation films according to the example were at minimum approximately one thirds of those of the insulation films according to the comparative example. As clear from this result, chemical-liquid resistance of the insulation film 100 made of aluminum oxide which contains the small amount of nitrogen is improved to a large extent in comparison with that of the conventional insulation film which contains no nitrogen.

It should be noted that it can be easily determined whether or not the insulation films contain nitrogen, for example, by means of a scan X-ray photoelectron spectral analyzer (μESCA), a secondary ion mass spectrometer (SIMS) or the like.

Figure 4:
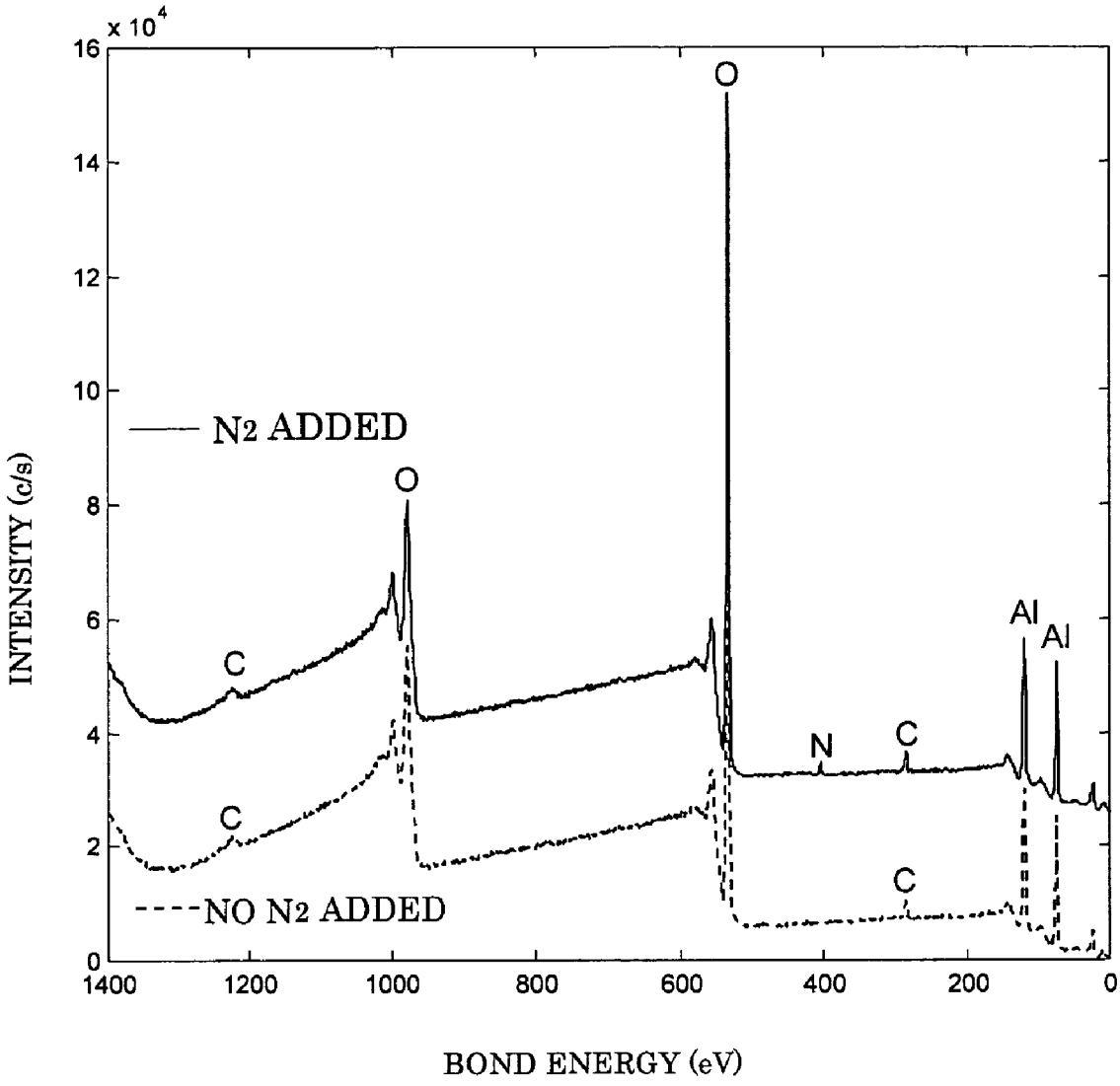
FIG. 4 is a graph showing a result of analysis on insulation films according to an example and insulation films according to a comparative example by means of a μESCA.
Figure 5:
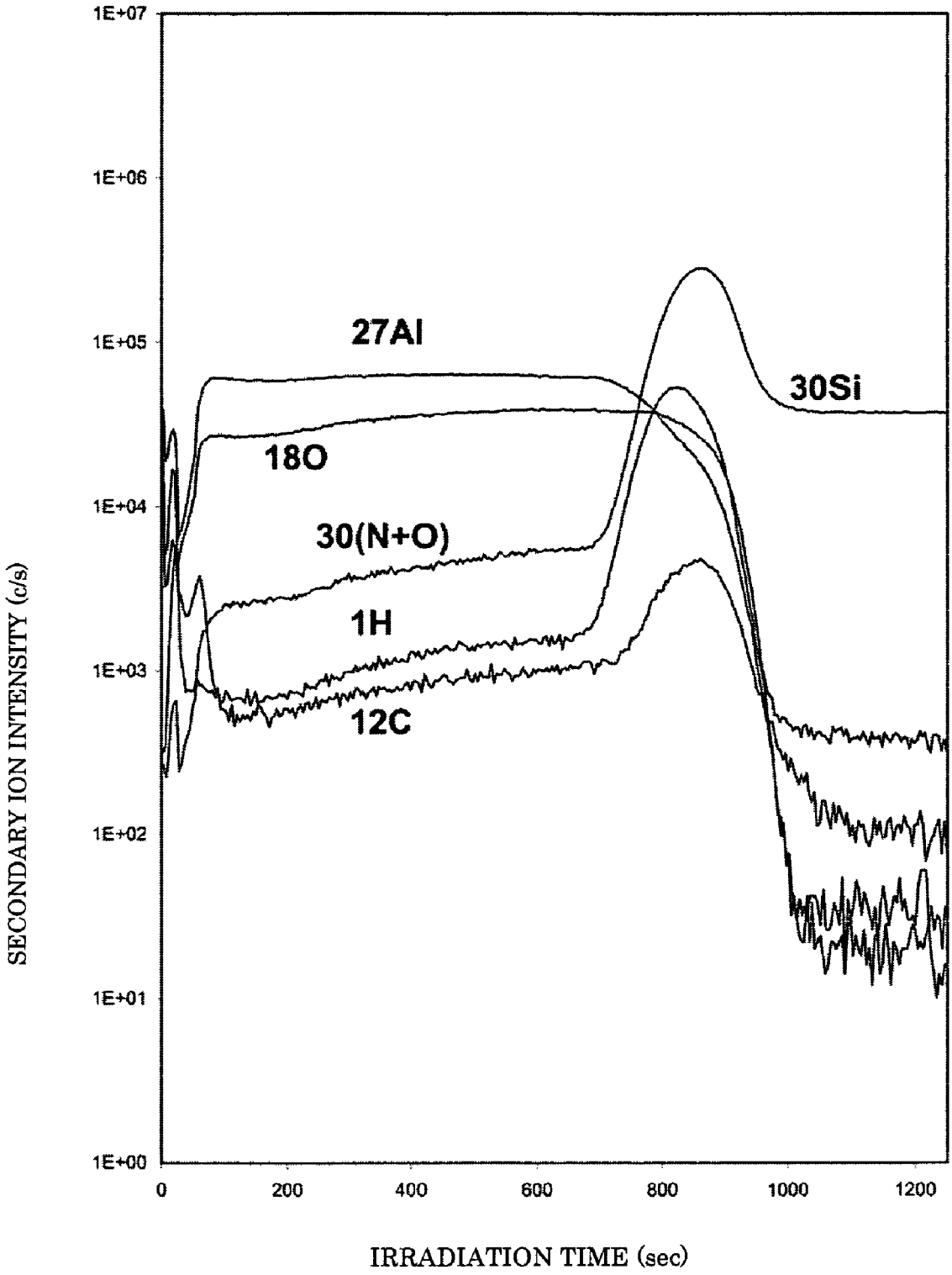
FIG. 5 is a graph showing a result of analysis on an insulation film according to the example by means of an SIMS.
Figure 6:
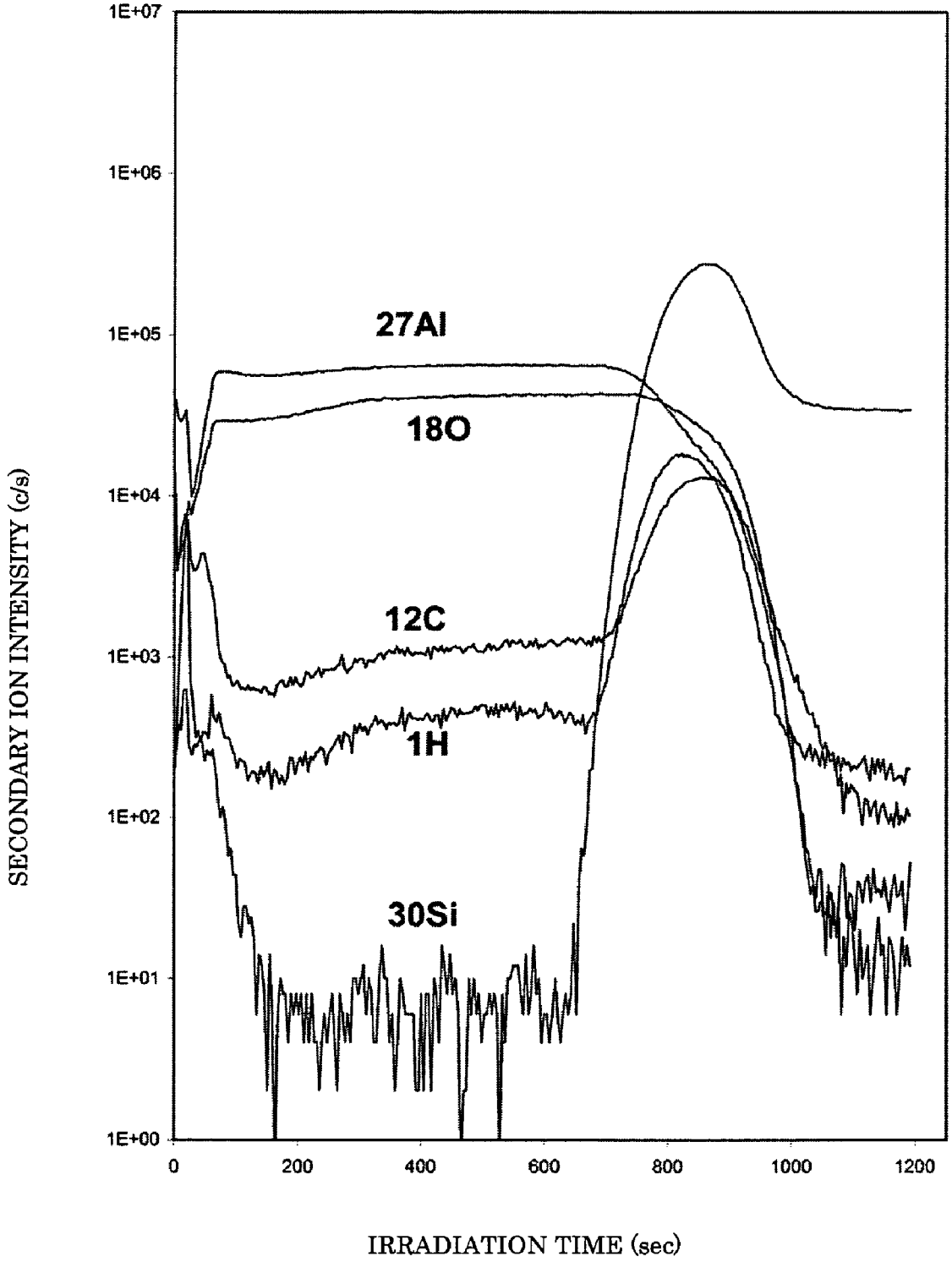
FIG. 6 is a graph showing a result of analysis on an insulation film according to the comparative example by means of the SIMS.

FIG. 4 is a graph showing a result of analysis on an insulation film ($N_2$ ADDED) according to the example and an insulation film (NO $N_2$ ADDED) according to the comparative example by means of the μESCA. FIG. 5 is a graph showing a result of analysis on the insulation film according to the example by means of the SIMS. FIG. 6 is a graph showing a result of analysis on an insulation film according to the comparative example by means of the SIMS. When the insulation film according to the example which contained nitrogen was analyzed by means of the μESCA, a peak corresponding to the nitrogen occurred at an approximately 400 eV bond energy. When the insulation film according to the comparative example which contained no nitrogen was analyzed by means of the μESCA, no peak occurred. For this reason, whether or not insulation films contain nitrogen can be easily determined depending on whether or not this kind of peak is present.

Furthermore, when the insulation film according to the example which contained nitrogen was analyzed by means of the SIMS, secondary ions corresponding to substances with an atomic weight of 30 were detected in a large amount in an area corresponding to the insulation film (in a range up to an approximately 800-second irradiation time). In other words, secondary ions of each of nitrogen (N: atomic weight of 14) and oxygen (O: atomic weight of 16) were detected respectively in a large amount. Incidentally, the chief material of the insulation film was aluminum oxide. For this reason, with the contained elements taken into consideration, it is clear that the secondary-ions intensity corresponding to the element with the atomic weight of 30 were those which corresponded to the nitrogen and the oxygen. In contrast to this, in the case of the insulation film according to the comparative example which contains no nitrogen, as shown in FIG. 6, secondary ions corresponding to the substances with the atomic weight of 30 were detected in a slight amount in the region corresponding to the insulation film. However, the detected secondary ions were those which corresponded to an isotope (Si: atomic weight of 30) of silicon. The intensity value was extremely low, and was apparently different from that of the insulation film according to the example. Incidentally, one may consider that the secondary ions corresponding to the isotope of silicon which was detected from the insulation film according to the comparative example stemmed from influence of the silicon substrate on which the insulation film had been formed.

When the insulation films were analyzed by the SIMS, the respective secondary-ions intensities corresponding to the substances with the atomic weight of 30 were apparently different from each other depending on whether or not the insulation films contained nitrogen. As a result, it can be easily determined whether or not nitrogen is contained in an insulation film, on the basis of the secondary-ions intensity corresponding to the substances with the atomic weight of 30.

Other Embodiments

Figure 7:
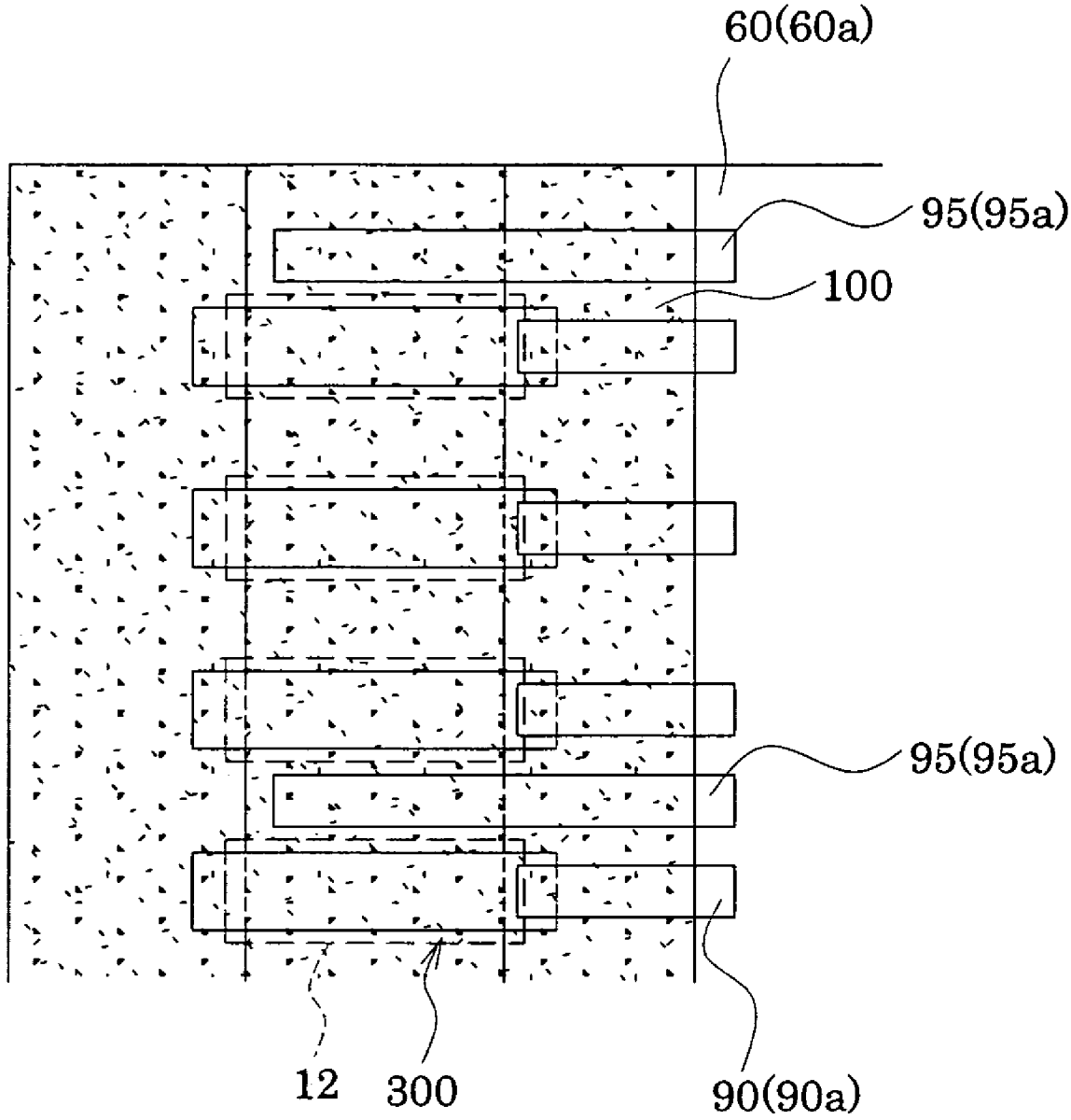
FIG. 7 is a plan view showing a main part of a recording head according to another embodiment.

The embodiment of the invention has been described. However, the invention is not limited to the embodiment which has been described. In the case of the embodiment, for example, the end portions of the lower electrode film 60 which are extended to the vicinity of the communicating portion 13 serve as the connection portions 60*a* where the lower electrode film 60 is connected with the corresponding connecting wires 130. However, it does not matter that, for example, as shown in FIG. 7, lead electrodes 95 electrically connected to the lower electrode film 60 are extended to a vicinity of the communicating portion 13 in the two outer sides of the row of the piezoelectric elements 300 arranged side-by-side and in interstices between each neighboring two of the piezoelectric elements 300, and that end portions of these lead electrodes 95 are thus caused to serve respectively as connection portions 95*a* where the lead electrodes 95 are connected with the corresponding connecting wires 130.

Furthermore, in the case of the embodiment, for example, the piezoelectric elements 300 are placed in the piezoelectric-element holding portion 31 in the protective plate 30. However, the placement of the piezoelectric elements 300 is not limited to the example of this embodiment. Of course, it does not matter that the piezoelectric elements 300 are exposed. Even in this case, the surfaces of the piezoelectric elements 300 and the lead electrodes 90 are covered with the insulation film 100 made of aluminum oxide, which contains the small amount of nitrogen. Accordingly, this makes it possible to reliably prevent the piezoelectric layers 70 from being broken due to moisture (dampness).

Figure 8:
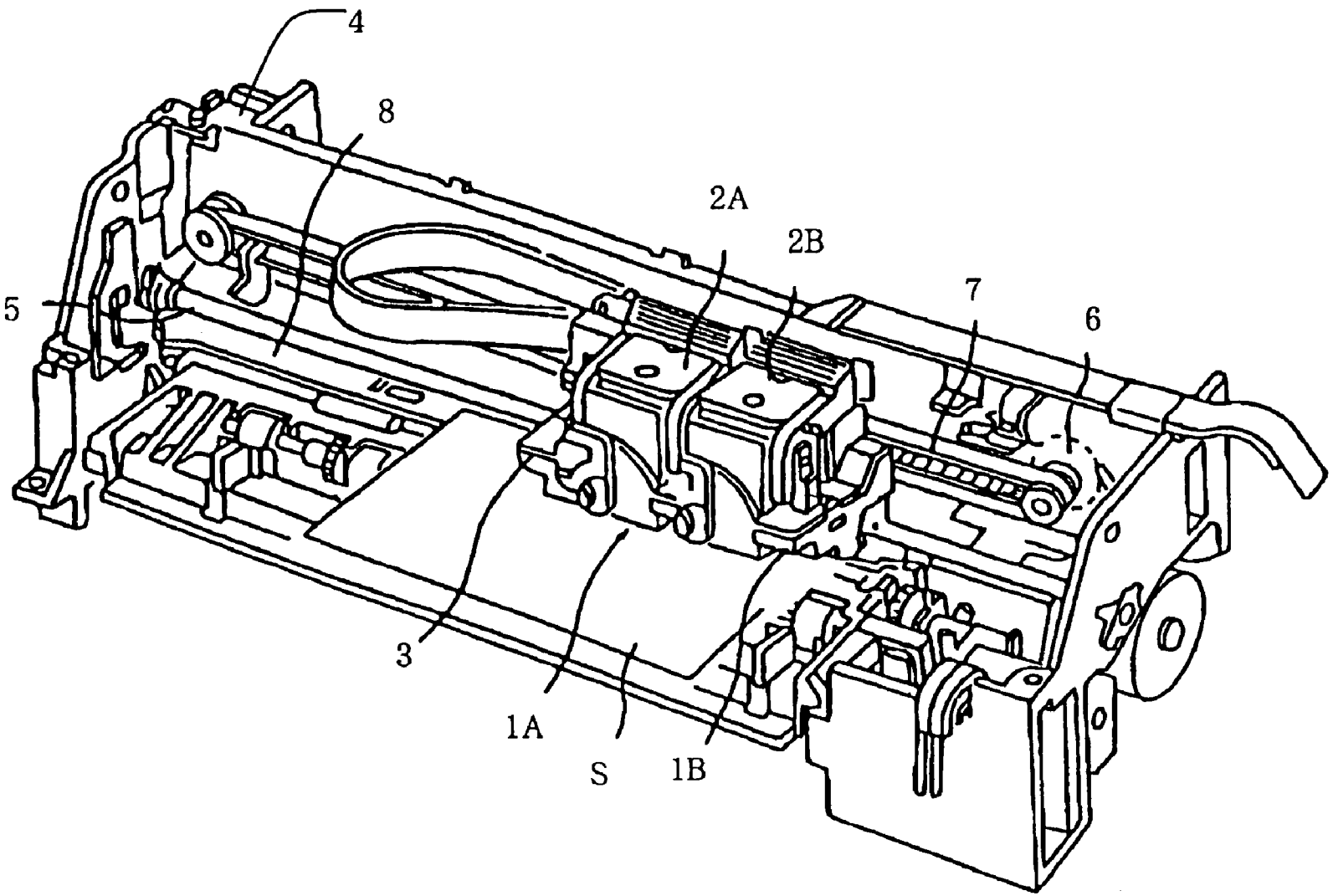
FIG. 8 is a schematic diagram of a recording apparatus according to an embodiment.

It should be noted that the inkjet recording head according to the embodiment constitutes a part of a recording head unit including ink passages communicating with an ink cartridge and the like, and thus is installed in an inkjet recording apparatus. FIG. 8 is a schematic diagram showing an example of the inkjet recording apparatus. As shown in FIG. 8, cartridges 2A and 2B are detachably provided to recording head units 1A and 1B with the respective inkjet recording heads. Each of the cartridges 2A and 2B constitutes ink supply means. A carriage 3 mounted with the recording head units 1A and 1B is provided to a carriage shaft 5 installed to a main body 4 of the apparatus in a way that the carriage 3 can be moved in the axial direction. The recording head units 1A and 1B are assigned to ejecting black ink compositions and color ink compositions respectively. In addition, a drive power from a drive motor 6 is transmitted to the carriage 3 through a plurality of gears, which are not illustrated, and a timing belt 7. Thereby, the carriage 3 on which the recording head units 1A and 1B are mounted is caused to move along the carriage shaft 5. On the other hand, the main body 4 of the apparatus is provided with a platen 8 along the carriage shaft 5. A recording sheet S, which is a recording medium such as a sheet of paper, is designed to be transferred on the platen 8. The recording sheet S is fed by feed rollers and the like, although the feed rollers are not illustrated.

In the case of the foregoing embodiment, the inkjet recording head has been described as an example of the liquid-jet head according to the invention. However, the basic configuration of the liquid-jet head is not limited to the example which has been described above. The invention is intended to be widely applied to the entire range of liquid-jet heads. It goes without saying that the invention can be applied to any other liquid-jet head which ejects a liquid other than ink. Examples of a liquid-jet head which ejects a liquid other than ink include: various recording heads used for image recording apparatuses such as printers; color-material-jet heads used for manufacturing color filters of liquid crystal display devices and the like; electrode-material-jet heads used for forming electrodes of organic EL display devices, FED (Field Emission Display) devices and the like; and bio-organic-substance-jet heads used for manufacturing bio-chips.

What is claimed is:

1. A liquid-jet head comprising:

a passage-forming substrate in which pressure generating chambers are formed, the pressure generating chambers communicating respectively with nozzle orifices from which to eject liquid droplets;

piezoelectric elements which are provided to one surface of the passage-forming substrate with a vibration plate interposed between the passage-forming substrate and each of the piezoelectric elements, the piezoelectric elements being configured of a lower electrode, piezoelectric layers and upper electrodes; and an insulation film made of an aluminum oxide thin film containing nitrogen, which is provided to at least areas corresponding to the piezoelectric elements and covers the piezoelectric elements, wherein an amount of the nitrogen contained in the insulation film is 1 wt % to 3 wt %.

2. The liquid-jet head according to claim 1, wherein the insulation film is formed by means of any one of a CVD method and a sputtering method.

3. A liquid-jet apparatus comprising:

the liquid-jet head according to claim 1; and a carriage on which the liquid-jet head is mounted.

4. A liquid-jet head comprising:

a passage-forming substrate in which pressure generating chambers are formed, the pressure generating chambers communicating respectively with nozzle orifices from which to eject liquid droplets;

piezoelectric elements which are provided to one surface of the passage-forming substrate with a vibration plate interposed between the passage-forming substrate and each of the piezoelectric elements, the piezoelectric elements being configured of a lower electrode, piezoelectric layers and upper electrodes; and an insulation film made of an aluminum oxide thin film containing nitrogen, which is provided to at least areas corresponding to the piezoelectric elements and covers the piezoelectric elements, wherein the nitrogen contained in the insulation film is present in a way that the nitrogen is segregated in a vicinity of a surface layer of the insulation film.

5. A liquid-jet head comprising:

a passage-forming substrate in which pressure generating chambers are formed, the pressure generating chambers communicating respectively with nozzle orifices from which to eject liquid droplets;

piezoelectric elements which are provided to one surface of the passage-forming substrate and an insulation film containing nitrogen, which is provided to at least areas corresponding to the piezoelectric elements and covers the piezoelectric elements, wherein the nitrogen is segregated in a vicinity of a surface layer of the insulation film.

6. A liquid-jet head comprising:

a passage-forming substrate in which pressure generating chambers are formed, the pressure generating chambers communicating respectively with nozzle orifices from which to eject liquid droplets;

a piezoelectric elements which are provided to one surface of the passage-forming substrate and an insulation film containing a resistant element having resistance to chemical liquids, which is provided to at least areas corresponding to the piezoelectric elements and covers the piezoelectric elements, wherein the resistant element is segregated in a vicinity of a surface layer of the insulation film.

* * * * *

UNITED STATES PATENT AND TRADEMARK OFFICE

CERTIFICATE OF CORRECTION

PATENT NO. : 7,604,328 B2
APPLICATION NO. : 11/475126
DATED : October 20, 2009
INVENTOR(S) : Masataka Yamada It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 595 days.

Signed and Sealed this

Fifth Day of October, 2010

David J. Kappos

David J. Kappos
*Director of the United States Patent and Trademark Office*